US008539720B2

(12) United States Patent
Ruusu

(10) Patent No.: US 8,539,720 B2
(45) Date of Patent: Sep. 24, 2013

(54) METHOD FOR REPAIRING A WALL STRUCTURE AND A WALL ELEMENT

(75) Inventor: Riku Petteri Ruusu, LansiTurunmaa (FI)

(73) Assignee: Almaco Group Oy, Turku (FI)

( * ) Notice: Subject to any disclaimer, the term of this patent is extended or adjusted under 35 U.S.C. 154(b) by 0 days.

(21) Appl. No.: 13/362,897

(22) Filed: Jan. 31, 2012

(65) Prior Publication Data

US 2012/0192778 A1 Aug. 2, 2012

(30) Foreign Application Priority Data

Jan. 31, 2011 (FI) ..... 20115092

(51) Int. Cl.
*A47K 3/16* (2006.01)

(52) U.S. Cl.
USPC ..... 52/34; 52/514; 29/897.1

(58) Field of Classification Search
USPC ..... 52/34, 746.1, 514; 156/98; 114/71; 29/897.1
See application file for complete search history.

(56) References Cited

U.S. PATENT DOCUMENTS

| | | | | |
|---|---|---|---|---|
| 4,311,656 | A * | 1/1982 | Spriggs | 264/36.2 |
| 4,517,038 | A * | 5/1985 | Miller | 156/98 |
| 4,989,385 | A * | 2/1991 | McCullough | 52/514 |
| 6,565,299 | B1 * | 5/2003 | Guilbault et al. | 410/69 |

FOREIGN PATENT DOCUMENTS

| | | |
|---|---|---|
| JP | 04-328088 | 11/1992 |
| JP | 04-328089 | 11/1992 |

* cited by examiner

*Primary Examiner* — Jeanette E Chapman
*Assistant Examiner* — Daniel Kenny
(74) *Attorney, Agent, or Firm* — James C. Lydon

(57) ABSTRACT

A method and a wall element for repairing a wall structure comprising at least an inner metal sheet, an outer metal sheet and an insulator layer between the inner and outer metal sheets. The method comprises at least the following steps: (i) removing the inner metal sheet in such a way that installation frames formed on the inner metal sheet are left in the wall structure, (ii) removing the insulator layer from a place where the inner metal sheet has been removed, (iii) installing a wall element comprising a metal sheet and an insulator layer attached to the metal sheet in the place of the removed wall structure in such a way that the edges of the metal sheet of the wall element are placed overlappingly with the installation frames.

8 Claims, 7 Drawing Sheets

METHOD FOR REPAIRING A WALL STRUCTURE AND A WALL ELEMENT

FIELD OF THE INVENTION

The invention relates to a method and a wall element for repairing a cabin wall structure according to the preambles of the independent claims presented below.

BACKGROUND OF THE INVENTION

Fire safety requirements related to ship cabins set certain requirements for the wall structures of the cabins. For example cabin walls compliant with fire proof class B-15 of International Maritime Organization (IMO Resolution A.754 (18) regarding Fire Resistance Tests) typically have a thickness of about 30 mm, and a wall structure comprising an inner and an outer metal surface, and a mineral wool insulator layer between the metal surfaces. This structure causes problems especially in the sanitary units of the cabins, where the metal surface toward the humid sanitary unit easily rusts. Thus, the wall structures of sanitary units have to be renewed for visual reasons and because corroded wall surfaces no longer fulfil the fire safety regulations. Similar problems can be faced with other fire proof classes such as C-0 and B-0, commonly used in ship cabins.

The repair of corroded wall structures is traditionally performed by demolishing the old wall structures and building a new wall step by step on location. Additionally, the sanitary fixtures must also be detached and generally renewed in connection with the demolishing.

In connection with a normal visiting of a cruise ship to the harbor, the visiting time is generally short, wherefore performing the multistage and time-consuming repairs according to the traditional way is difficult. When the ship is in use and it has a lot of passengers, rebuilding the wall structures is difficult, since the repairing comprises several work stages, which cause noise and dust problems. In other words repairing the cabins while the ship is in use is practically impossible by using the traditional way. In a large cruise ship, there can be a remarkable number of cabins to be repaired, so a part or even all of the cabins are out of use in connection with the repair. Repairing all of the cabins at one time requires a lot of time, whereby the cruise ship is out of use, and this is not economically profitable.

SUMMARY OF THE INVENTION

The aim of the present invention is to reduce or even eliminate the above-mentioned problems appearing in prior art.

The aim of the present invention is to obtain a novel method for repairing a wall structure, which reduces work stages of the wall repairing and thus also shortens the time required for the repairing.

The aim of the invention is especially to provide a method for repairing a wall structure of a cabin of a cruise ship.

The aim of the invention is especially to provide a method for repairing a corroded wall structure of a sanitary unit of a cabin.

It is another aim of the present invention to provide a quick and cost-efficient solution to the renovation of the wall structures of the cabins.

It is another aim of the present invention to provide a method for repairing wall structures, which can be carried out during a cruise without disturbing the passengers.

To achieve these aims, the method and the wall element according to the invention are characterized by what is presented in the characterizing parts of the enclosed independent claims.

Some preferred embodiments of the invention will be described in the other claims.

A typical method and wall element according to the invention can be used for repairing a cabin wall structure, which comprises at least an inner metal sheet, an outer metal sheet and an insulator layer between the inner and outer metal sheets.

A typical method according to the invention for repairing the above-mentioned cabin wall structure comprises at least the following steps

- removing the inner metal sheet in such a way that installation frames formed on the inner metal sheet are left in the wall structure,
- removing the insulator layer from a place where the inner metal sheet has been removed,
- installing a wall element comprising a metal sheet and an insulator layer attached to the metal sheet in the place of the removed wall structure in such a way that the edges of the metal sheet of the wall element are placed overlappingly with the installation frames.

A typical wall element according to the invention for repairing the above-mentioned cabin wall structure comprises at least an insulator layer having a first side and a second side, and a metal sheet attached to the first side of the insulator layer, and the area of the metal sheet of the wall element is greater than the area of the insulator layer of the wall element, in such a way that the edges of the metal sheet extend over the edges of the insulator layer, in order for the wall element to be installable to the repairable wall structure by means of these edges.

The method according to the invention can preferably be used to repair wall structures of cabins of a cruise ship. The fire safety requirements require that the wall structure of the cabin has to comprise at least an insulator layer having a first side and a second side, and an inner metal sheet attached to the first side of the insulator layer and an outer metal sheet attached to the second side of the insulator layer. Thus, the method according to the invention can be used to repair fire proof and/or sound proof wall structures.

The method according to the invention can especially be used to repair a corroded wall structure of a sanitary unit of a cabin. The inner metal sheet of the wall structure described in this text is the wall surface of the sanitary unit, which easily rusts in the humid sanitary unit.

The method and the wall element according to invention can also be used to repair all other wall structures corresponding to the wall structure of the cabins mentioned above. For example, sanitary units of hotels can be constructed by using same kind of wall structures.

The present invention is based on the fact that by using ready-made wall elements, the corroded or otherwise damaged wall structures of the cabins can be repaired during the cruise. The ready-made wall elements can easily be delivered to the cruise ship, and they make it possible to do maintenance work in cabins also when the ship is in use, because the work can be performed quickly and cleanly without time consuming work stages.

A typical wall element according to the invention is a ready-made wall element comprising an insulator layer and a metal sheet attached to the insulator layer, and the insulator layer of the wall element has the same size and shape as the demolished wall structure, in the place of which the wall element will be fitted in the structure of the wall. The metal sheet of the wall element also has the same shape, but the size is a greater than the size of the insulator layer and the demolished wall structure, in such a way that the edges of the metal sheet extend over the edges of the insulator layer so that the wall element is installable to the repairable wall structure by means of these edges. In one embodiment of the invention at least two opposed edges of the metal sheet extend over the insulator layer in the structure of the wall element. Preferably, all edges of the metal sheet extend over the edges of the insulator layer. In one embodiment of the invention, the edges of the metal sheet, which extend over the edges of the insulator layer, have a width of 10-100 mm, preferably 30-60 mm and most preferably about 50 mm.

In the method according to the invention, the corroded or otherwise damaged inner metal sheet of the wall structure is removed in such a way that only a narrow strip, so-called installation frame, of the inner metal sheet is left in the edges of the opening made in the wall. Preferably, the installation frame is left around the opening made in the wall. The installation frames formed on the original inner metal sheet have a width of 10-100 mm, preferably 30-60 mm and most preferably about 50 mm.

In one embodiment of the invention, the installation frame is left at least in two opposed edges of the rectangular or square opening made in the wall.

In some embodiments installation frames can be arbitrary forms i.e. for example installation frame 407 could be partial i.e. for example having frame only on parts: 100-300 mm from the bottom, in middle area 1000-1300 mm from the bottom, or in top area 1900-2100 mm from the bottom.

After removing the inner metal sheet, also the insulator layer is removed from the place of the wall structure where the inner metal sheet is removed. The outer metal sheet of the wall structure is not removed from the structure.

A new ready-made wall element according to the invention, which comprises an insulator layer and a metal sheet attached to the surface of the insulator layer, is installed in the place of the demolished wall structure, and it is fastened to the installation frame of the original metal sheet. The insulator layer of the wall element is placed inside the wall structure.

The new wall element is installed in such a way that the edges of the metal sheet are placed overlappingly with the installation frame formed in the wall structure. Preferably, the new wall element is installed in such a way that all edges of the metal sheet are placed overlappingly with the installation frame. In the case of the rectangular or square installation frame, at least two opposed edges of the metal sheet of the wall element are installed overlappingly with the installation frame.

The wall element can be attached to the installation frame by using glue or a corresponding material, which fulfils the fire requirements. In addition to using glue to attach the new wall element, screws, welding, fast connectors, rivets, etc. can be used to attach the wall element.

According to an embodiment there are no old installation frames but the new element is attached to the outer metal sheet using fasteners or glue.

The repaired wall structure is ready after the installation of the wall element. The wall element does not need any further finishing steps after fastening the element to the installation frame.

According to an embodiment of the invention the ready-made wall element can comprise fast connectors for sanitary fixtures. Thus, new sanitary fixtures can easily be installed to the wall element by means of the fast connectors. Thus, the renovation of the sanitary unit can be carried out easily and quickly.

According to an embodiment of the invention the metal sheet of the installable wall element has a thickness of about 0.7-1.5 mm, depending on material. For example, the metal sheet can be made of steel or aluminum.

According to an embodiment of the invention the insulator layer is made of mineral wool or hard rock wool or any other insulator material suitable for installation and preferably complying with standards and regulations. Typically the thickness of the insulator layer is about 25 mm, but depending on the thickness of the cabin wall elements, the thickness of the insulator layer is for example 20-50 mm. A typical size of a wall element in a cabin sanitary area is 1.5 m×2.1 m.

According to an embodiment of the invention the wall element can comprise at least one reinforcement element attached to inside of the metal sheet, which is needed to harden the structure of the wall element and act as the place to install sanitary fixtures.

DESCRIPTION OF THE DRAWINGS

The invention will be described in more detail with reference to the appended drawings, in which.

DETAILED DESCRIPTION OF THE INVENTION

Figure 1:
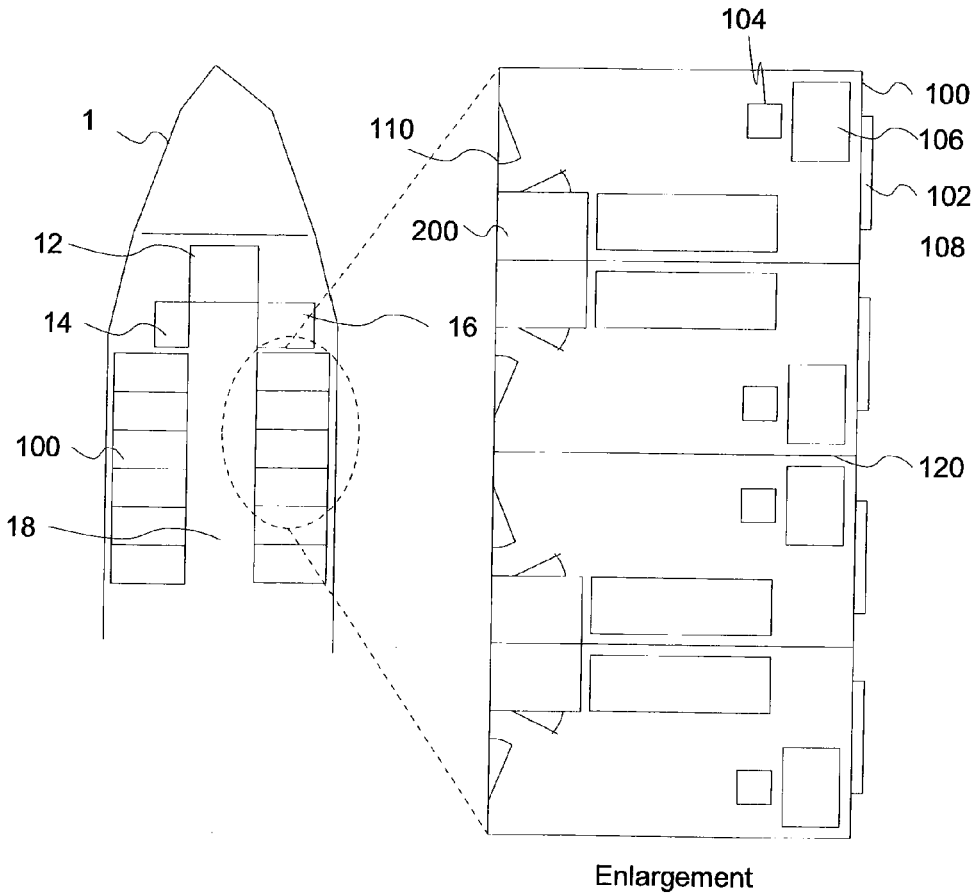
FIG. 1 shows a schematic drawing of a cabin deck in a cruise ship.

FIG. 1 shows a schematic drawing of a cabin deck in a cruise ship. The ship body 1 typically contains multiple decks. In a typical cabin deck there are multiple cabins 100 separated with fire and sound proof walls 120. In addition to the cabins 100 there may be stairways 12 and elevators 14 to enable access to a deck below and above the deck. A deck can also have other facilities such as public toilets 16 or other sanitary areas. Cabins 100 are lined along hallway 18.

Cabins 100 are typically assembled as mirror images as shown in the enlargement part of FIG. 1. A cabin includes a door 110, some furniture such as a table 106, a chair 104 and a bed 108. Cabins might include a window 102 to enable passengers to have ocean view.

Cabins typically include sanitary/water closet (wc)/shower unit 200.

Figure 2:
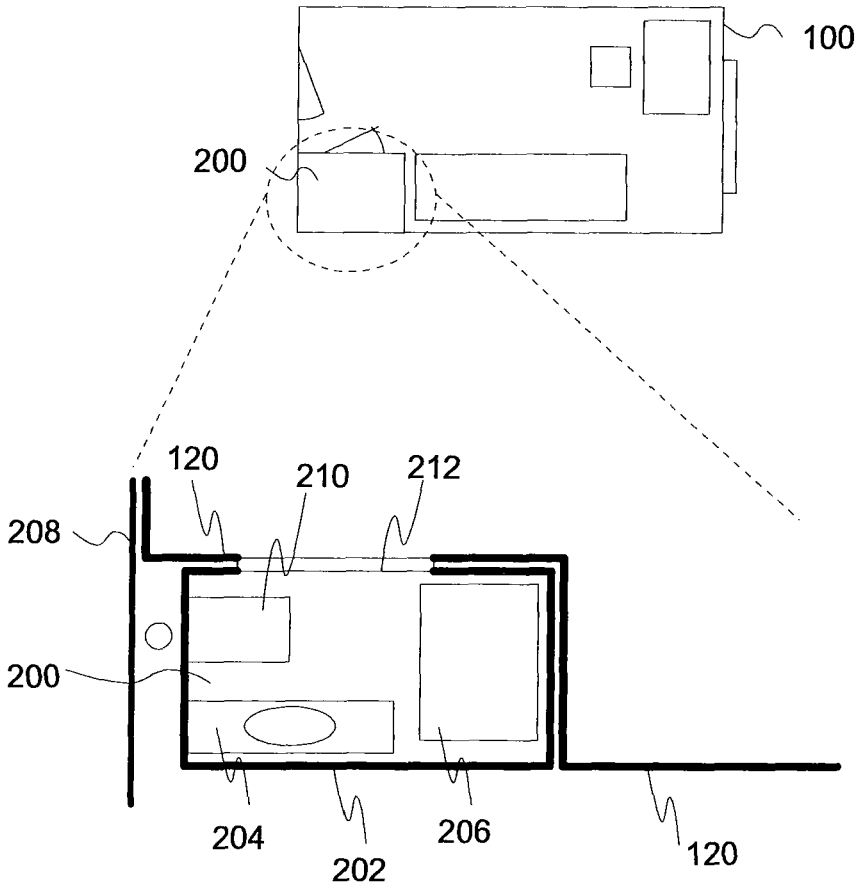
FIG. 2 shows a more detailed view of a sanitary area of a cabin.

FIG. 2 shows a more detailed view of a sanitary unit 200 of a cabin 100 and some wall structures related to the cabin 100 and the sanitary unit 200. The Cabin typically has fire proof walls 120. In an example embodiment the sanitary unit 200 is located outside of the main body of the cabin. The sanitary unit is surrounded with other fire proof wall structures 202. Typically the fire proof classification is B-15 of IMO. In another embodiment the sanitary unit is located inside the main body of the cabin i.e. inside the wall structure 120. In said embodiment the wall classification can be for example C0, i.e. only sound proof, since no fire blocking is needed. The sanitary unit 200 can include a WC (Water Closet) seat 210 typically connected to the wall close to the hallway 18 of the ship 1, a wash basin 204 connected to the wall structure 202, a shower area 206. There is a door frame 212 connecting the sanitary unit wall structure 202 and the cabin structure 120. There can be a separate wall 208 between the hallway and the cabin 100.

In some embodiments the wall structure between the sanitary area and the cabin can be common (sometimes referred to as single cassette setup compared to double cassette setup). In such a structure there is a metal surface on the cabin side and a metal surface on the sanitary area side. The insulator layer is between the surfaces.

Figure 3:
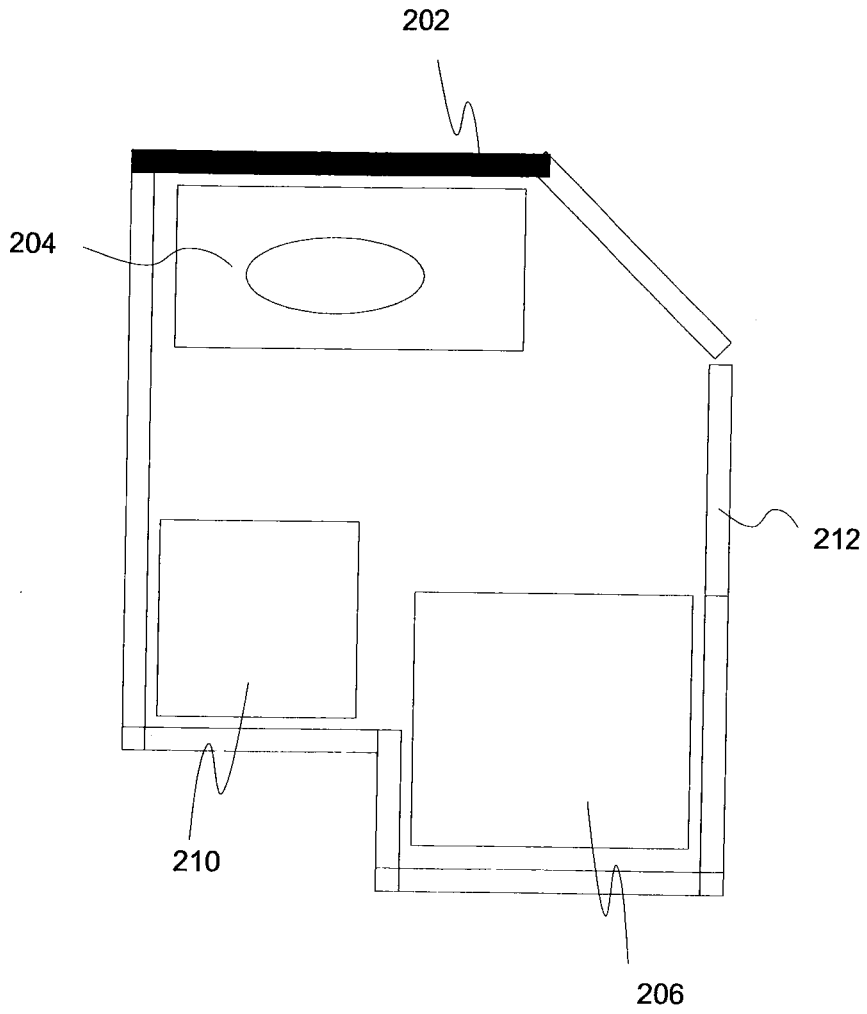
FIG. 3 shows an example of a sanitary module.

FIG. 3 shows an example of another sanitary module 200 which can be installed within a cabin or outside of a cabin wall 120 as in the previous example. In one embodiment of the invention part of the sanitary area is planned to be renewed due to corrosion problems. Said part of the sanitary unit wall structure 202 is marked with solid black color in FIG. 3 for clarification purposes. A renewable wall can in an embodiment be any wall of a sanitary module or several walls or all the walls.

Figure 4:
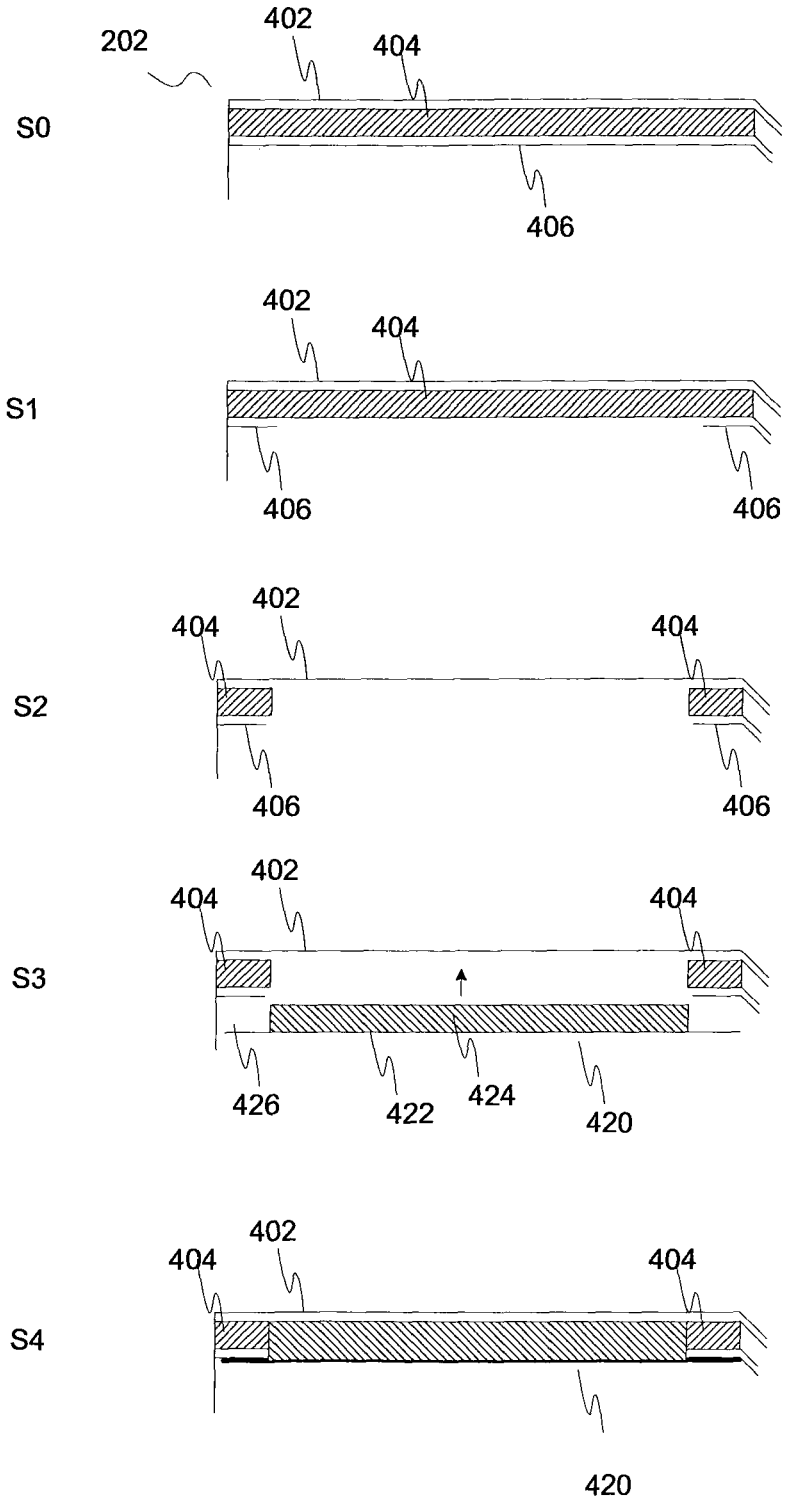
FIG. 4 shows, in cross-sectional views, a step of the method according to the invention for repairing wall structure.

The structure of the wall 202 can be a sandwich structure as shown in FIG. 4 of a metal wall 402 with a thickness of 1.2 mm of steel on the cabin side and about 25 mm of hard rock wool insulator 404 and another metal wall 406 with a thickness of 1.2 mm of steel at the sanitary unit side. According to an embodiment of the invention in step S1 a part of the inner steel wall 406 is removed with a purposed tool (such as clipping machine) as shown in FIG. 4. The removal is done preferably so that installation frames of 30-60 mm of the old inner steel part 406 are left in structure.

In the next step S2, the hard rock wool insulator is removed with a tool or by hand. In step S3 an installable wall element 420 of an embodiment of the invention is installed in the opening made in the wall. The installable wall element 420 consists of a metal structure 422 for example of steel with thickness of 1.2 mm and a sufficiently thick hard rock wool insulator material 424 (insulator layer). The installation can be done for example using glue 426 between the installable element 420 and the frame of the old inner structure 406. The ready wall is shown in step S4 of FIG. 4. The typical total thickness of a wall is about 27 mm. The metal structure 422 can in addition to steel be for example aluminum or another material. The corresponding thickness can typically vary between 0.7 mm to 1.5 mm, where 0.7 mm could be applied to a more robust material such as steel and for example 1.5 mm to a more soft material like aluminum as an example.

Figure 5:
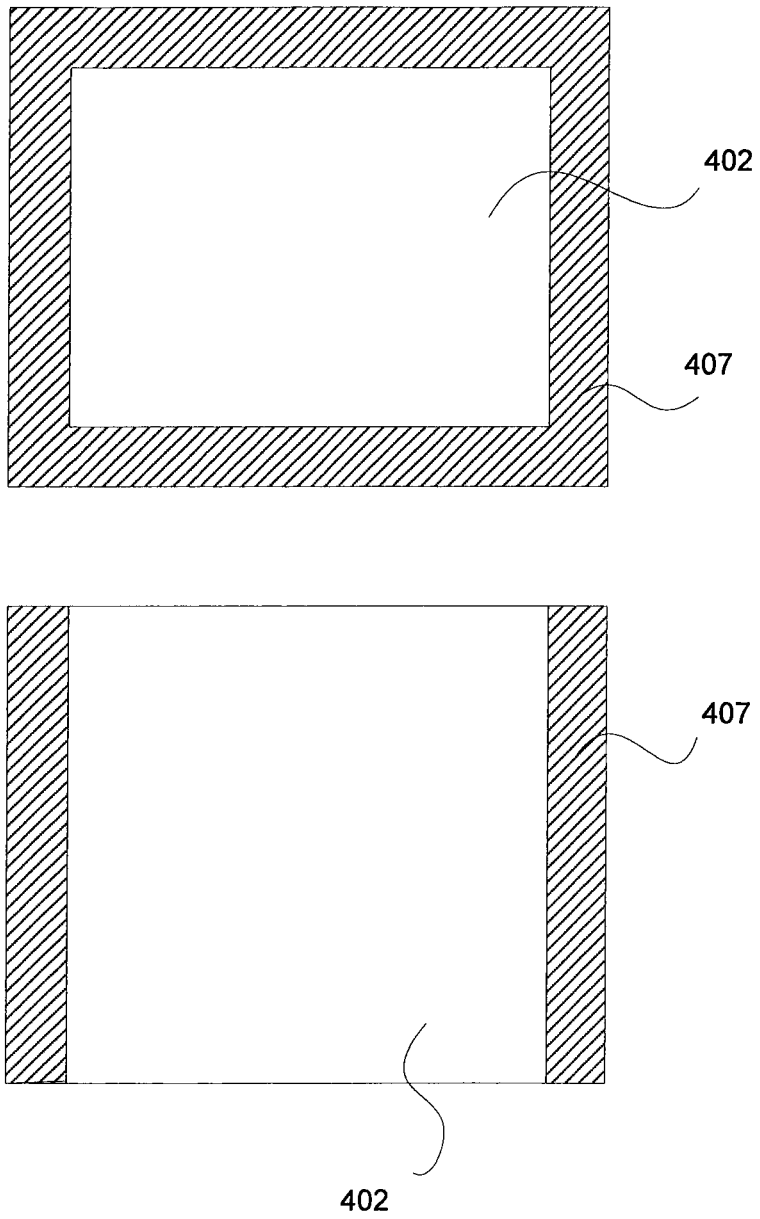
FIG. 5 shows examples of installation frames left in the structure of the demolished wall.

FIG. 5 shows two possible structures of the installation frames 407 formed on the inner metal sheet. In the figures, the insulator layer has also been removed from the place where the inner metal sheet has been removed, so only the outer metal sheet 402 is visible in the openings made in the wall structure. The installation frame 407 can be formed so that the narrow strips of the original inner metal sheet are left around the opening made in the wall, as shown in the upper drawing. Alternatively, the strips of the inner metal sheet forming the installation frame 407 can be left only in the two opposed edges of the rectangular or square opening made as shown in the lower drawing. The number of edges with frames could actually be any number, depending on how many edges are in the wall (one, two, three, four etc).

Figure 6:
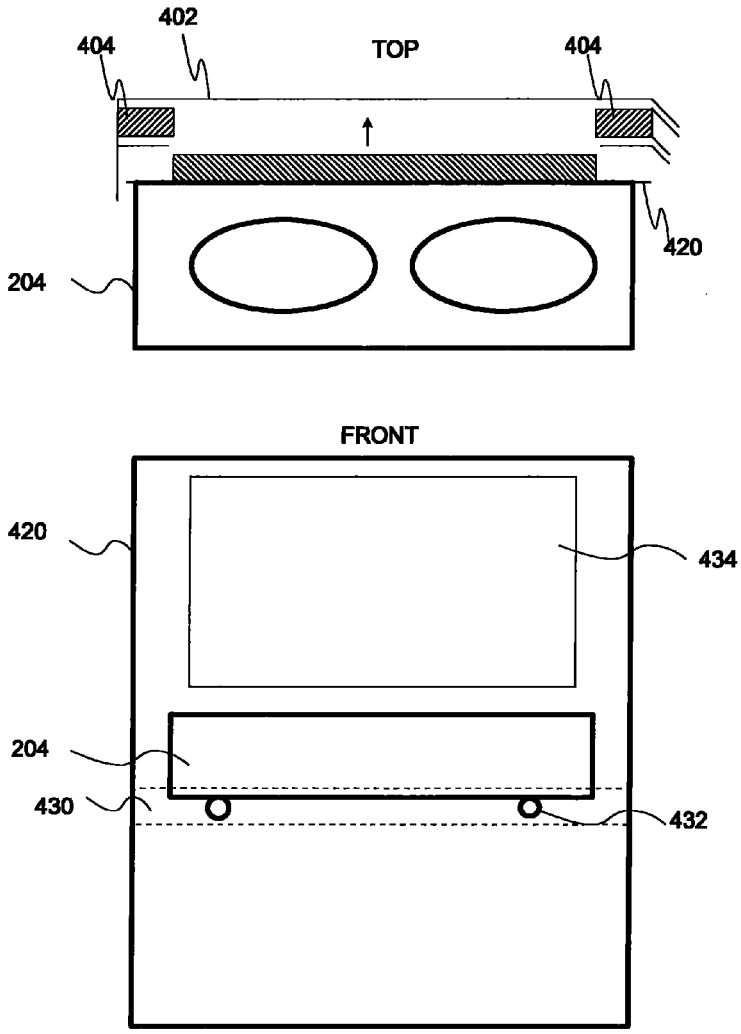
FIG. 6 shows an example embodiment where some equipments are preinstalled in the wall element.

FIG. 6 shows an example embodiment where some equipment, like a new wash basin 204, is preinstalled in the wall element, as well as a mirror and a lighting element/fixture 434. The wall element 420 can contain structures like 430, typically inside of the element, needed to harden the structure and act as a place to install equipment. There might be fast connectors 432 in the element such as bolts embedded in the elements to enable installation and de-installation of equipment.

The described steps enable fast renewal of sanitary areas of the cabins, reducing the current work of at least a working day to less than an hour. This makes it possible to do maintenance work in cabins even during the time a passenger is having dinner when at sea or is visiting shore when on a cruise. Additional benefits include the possibility to renew some of the cabin areas during normal visits to harbor with wall elements. Additionally the element approach is not limited to cabin sanitary areas only but can be applied to any sandwich type of structure in ships or other constructions.

Figure 7:
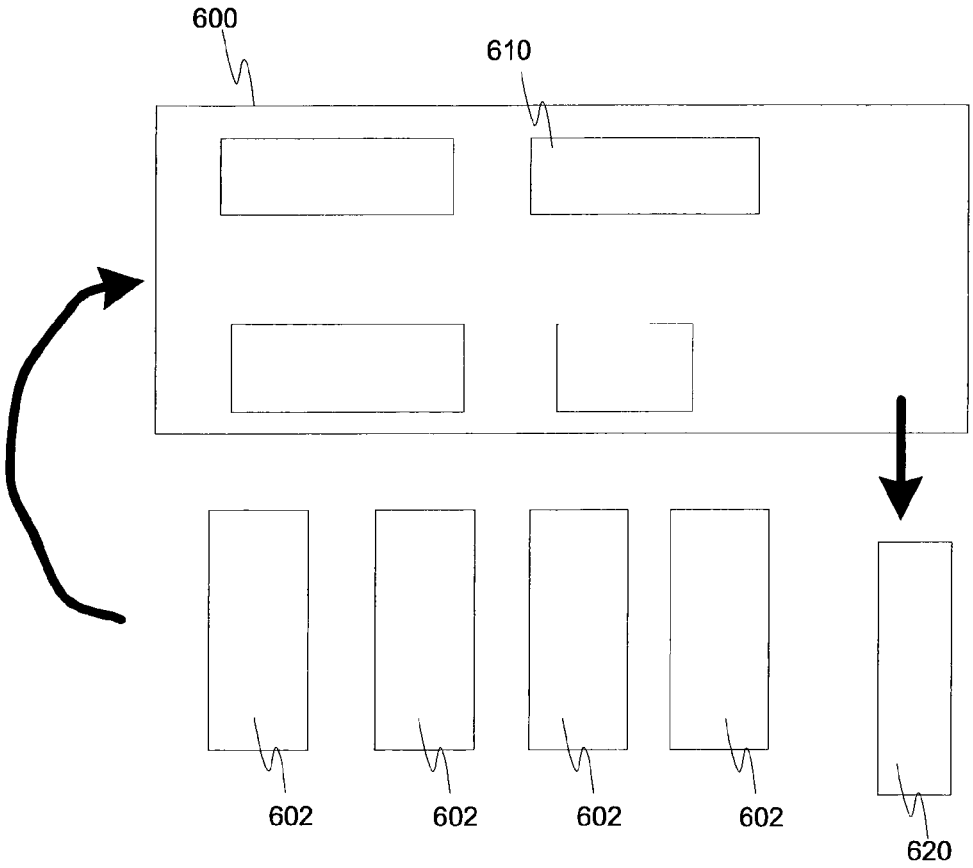
FIG. 7 shows a further embodiment of the invention.

According to a further embodiment of the invention there is an assembly line in the harbor or ship yard as shown in FIG. 7. There is a hall 600 with a plurality of assembly lines 610, for example vanity assembly line, wall kit assembly line, area for prefabrication and storage, workshop, re-packing wall kit area etc. Wall kits are assembled and packaged in the hall. They are transported to the ship using a car 620 when the ship is in the harbor. Materials can be stored close to the hall 600 in containers 602. There can be for example container for wall kits, mirrors, sinks, lower shelves, border tiles, mirror cabinets, faucet and piping and other installation material.

The invention is not restricted to the examples of the above description, but it can be modified within the scope of the inventive idea presented in the claims.

The invention claimed is:

1. A method for repairing a wall structure (202) of a sanitary unit of a cabin comprising at least an inner metal sheet (406) forming the wall surface of the sanitary unit, an outer metal sheet (402) and an insulator layer (404) between the inner and outer metal sheets, which method comprises at least the following steps removing the inner metal sheet (406) in such a way that installation frames formed on the inner metal sheet are left in the wall structure, removing the insulator layer (404) from a place where the inner metal sheet has been removed, installing a wall element (420) comprising a metal sheet (422), an insulator layer (424) attached to the metal sheet and fast connectors (432) for sanitary fixtures in the place of the removed wall structure in such a way that the edges of the metal sheet (422) of the wall element are placed overlappingly with the installation frames.

2. The method according to claim 1, wherein the wall structure (202) is a fire proof wall structure.

3. The method according to claim 1, wherein the installation frame formed on the inner metal sheet (406) has a width of 10-100 mm.

4. The method according to claim 1, at least two opposed edges of the metal sheet (422) of the wall element (420) are placed overlappingly with the installation frame.

5. The method according to claim 1, wherein the wall element (420) is attached to the installation frame using glue.

6. The method according to claim 1, wherein the wall structure (202) is a sound proof wall structure.

7. The method according to claim 3, wherein the installation frame formed on the inner metal sheet (406) has a width of 30-60 mm.

8. The method of according to claim 7, wherein the installation frame formed on the inner metal sheet (406) has a width of about 50 mm.

* * * * *